United States Patent [19]

Forney, Jr. et al.

[11] Patent Number: 4,662,703

[45] Date of Patent: May 5, 1987

[54] COAXIAL CONNECTOR WITH IMPROVED RETENTION OF A CENTER CONTACT

[75] Inventors: Edgar W. Forney, Jr., Harrisburg; Richard S. Hogendobler, Camp Hill, both of Pa.

[73] Assignee: AMP Incorporated, Harrisburg, Pa.

[21] Appl. No.: 765,617

[22] Filed: Aug. 14, 1985

[51] Int. Cl.[4] ..... H01R 17/18

[52] U.S. Cl. ..... 339/177 R; 339/275 R; 339/219 R

[58] Field of Search ..... 339/177, 218 R, 218 M, 339/8 R, 143 R, 147 R, 275 R, 275 B

[56] References Cited

U.S. PATENT DOCUMENTS

| | | | |
|---|---|---|---|
| 3,292,117 | 12/1966 | Bryant et al. | 339/177 R |
| 3,870,978 | 3/1975 | Dreyer | 339/147 R |
| 4,022,518 | 5/1977 | Gattaz | 339/8 R |
| 4,266,844 | 5/1981 | Chelminski | 339/218 M |
| 4,334,730 | 6/1982 | Colwell et al. | 339/218 R |
| 4,572,605 | 2/1986 | Hess | 339/218 M |

FOREIGN PATENT DOCUMENTS

| | | | |
|---|---|---|---|
| 0877668 | 10/1981 | U.S.S.R. | 339/177 R |

*Primary Examiner*—Gil Weidenfeld
*Assistant Examiner*—David Pirlot
*Attorney, Agent, or Firm*—Gerald K. Kita

[57] ABSTRACT

An electrical connector comprises: a conductive outer shell 2 for releasable connection with an electrical coaxial cable, a dielectric body 3 coaxially surrounded by the outer shell, and a conductive center contact 4 coaxially surrounded by the dielectric body and having an electrical contact portion 14 for releasable connection with the coaxial cable and an electrical terminal portion 13 for connection with an electrical circuit, characterized in that, the center contact has a portion having a roughened outer surface 18, the dielectric body engages the center contact and has a portion flowed into interlocked engagement with the roughened outer surface.

1 Claim, 8 Drawing Figures

1
2
3
4
5
6
7
8
9
11
12
13
14
15
16
17
18

COAXIAL CONNECTOR WITH IMPROVED RETENTION OF A CENTER CONTACT

FIELD OF THE INVENTION

The invention relates to an electrical coaxial connector, and more specifically, a coaxial connector wherein the component parts are interlocked with one another to resist movement.

BACKGROUND OF THE INVENTION

U.S. Pat. No. 3,292,117 discloses a coaxial connector having component parts including, a conductive center contact coaxially surrounded by a dielectric body of insulation material, in turn, surrounded coaxially by a conductive shell for disengageable connection with an electrical coaxial cable. The component parts are interlocked by a pin constructed in the following manner. An opening extends through the thickness of the outer shell and is aligned with another opening which extends entirely through the dielectric body and intercepts the center contact. The aligned openings are filled with a fluent and solidifiabe dielectric material such as epoxy. The epoxy then solidifies and forms a rigid pin which resists movement of the center contact and the dielectric body with respect to the outer shell.

According to the invention, a dielectric body of a coaxial connector coaxially surrounds a conductive electrical contact of the connector. The dielectric body has thermoplastic properties. Further, the dielectric body and center contact are adjusted in desired alignment with each other. A portion of the dielectric body is heated inductively by the application of radio frequency energy and is caused to flow into interlocked engagement with a portion of the center contact which has a surface roughened by knurling. Because the center contact is interlocked with the dielectric body, movement of the center contact is resisted. The parts are interlocked without disturbing the alignment of the dielectric body and center contact. The interlocking feature is provided without contributing to an increase in cumulative tolerances of the assembled parts of the connector.

An electrical connector according to the invention comprises a conductive outer shell for releasable connection with an electrical coaxial cable, a dielectric body coaxially surrounded by the outer shell, and a conductive center contact coaxially surrounded by the dielectric body and having an electrical contact portion for releasable connection with the coaxial cable and an electrical terminal portion for connection with an electrical circuit, characterized in that, the center contact has a portion having a roughened outer surface, the dielectric body engages the center contact and has a portion flowed into interlocked engagement with the roughened outer surface.

An object of the invention is to provide an electrical coaxial connector with interlocked component parts.

Another object of the invention is to provide an interlocking structure that maintains the low signal loss properties of the dielectric body, particularly in the sensitive area surrounding the center contact.

Another object of the invention is to provide an electrical coaxial connector with component parts of the connector having interlocking features that are provided without contribution to cumulative tolerances in the assembly of the component parts.

Another object of the invention is to provide an electrical coaxial connector with a conductive outer shell and a dielectric body interlocked to the outer shell by a collar formed by a solidifiable material.

Another object of the invention is to provide an electrical coaxial connector with a conductive outer shell, a conductive center contact and a dielectric body coaxially surrounding the center contact and flowed into interlocked engagement with the center contact.

Other objects and advantages are present and are intended to be covered in the description of the invention and the accompanying drawings.

DESCRIPTION OF THE DRAWINGS

With reference to FIGS. 1 and 2 of the drawings, an electrical coaxial connector 1 includes a conductive outer shell 2, a dielectric body 3 and a conductive center contact 4. The outer shell 2 is cylindrical with an axial bore 5 and a forward mating end 6 for releasable connection with an electrical coaxial cable 7. In practice, external threads 8 on the mating end 6 are for threaded connection with a coaxial connector 9 assembled with the coaxial cable 7. The connector 9 is known from U.S. Pat. No. 4,070,751. The outer shell 2 has a flange 10 with apertures 11 through the thickness of the flange 10. The flange 10 is for mounting to a wall (not shown) with fasteners such as screws (not shown) held by the apertures and secured threadably in the wall. For example, the wall may be part of a housing that contains an electrical circuit path known as a strip line for carrying electrical signals of microwave frequency.

Figures 1, 2:
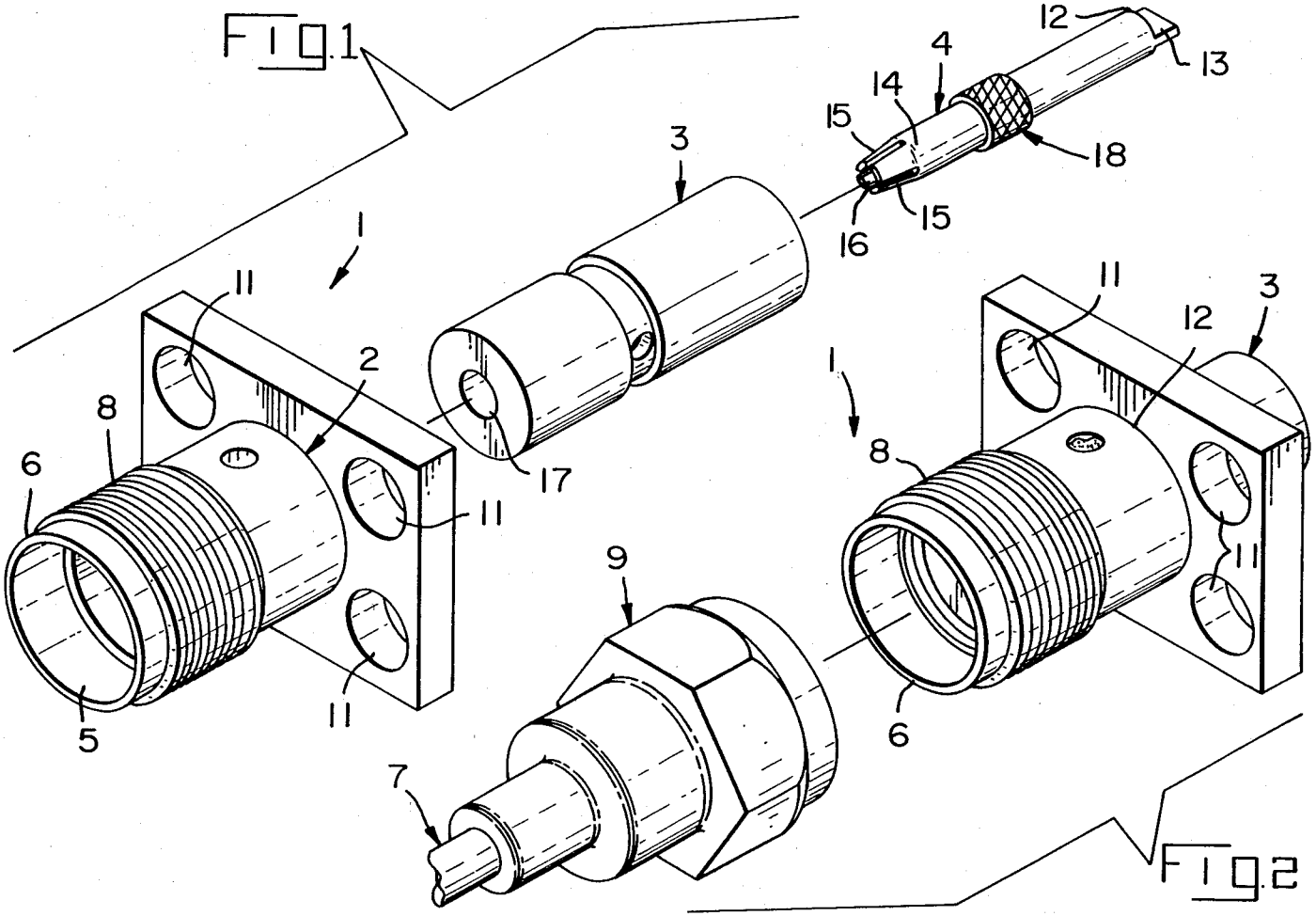
FIG. 1 is a perspective view of an electrical coaxial connector according to the invention with parts illustrated in exploded configuration.
FIG. 2 is a perspective view of the parts assembled.

The center contact 4 has a rearward end 12 having a flat tab 13 extending axially of the center contact 4 and in a rearward direction of the connector 1 for connection to the strip line, for example, by the application of conductive solder. The center contact 4 is provided at its forward end with an electrical receptacle 14. The receptacle 14 has radially spaced apart fingers 15 extending toward the forward end of the connector 1. The fingers 15 are separated by slits 16 extending axially of the center contact 4 and communicating with the forward end of the contact 4. The receptacle 14 is for releasable connection with a center contact of the coaxial connector 9.

Figure 3:
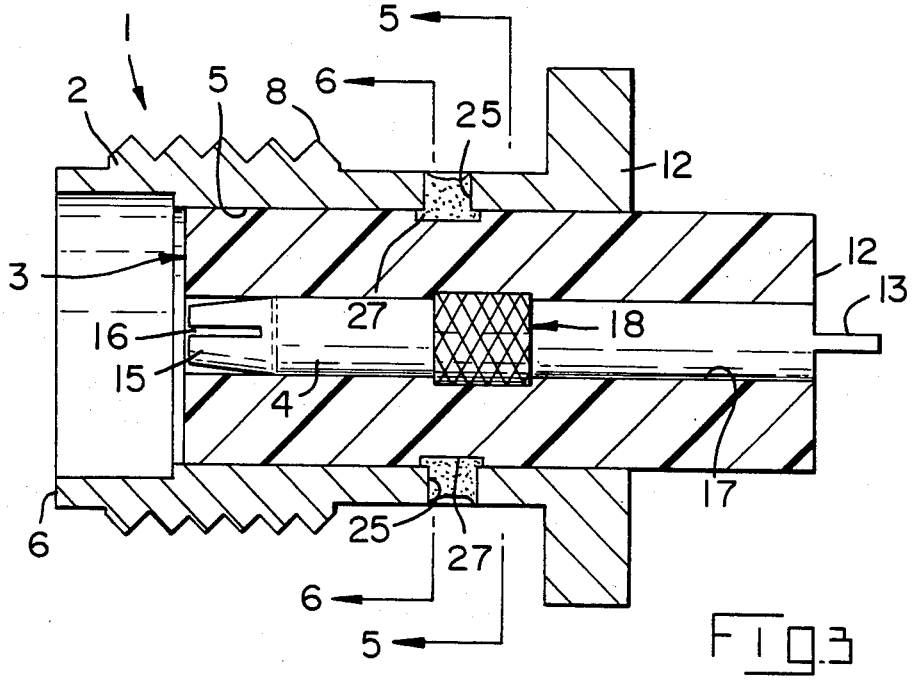
FIG. 3 is an elevation view in section of the parts assembled.
Figure 4:
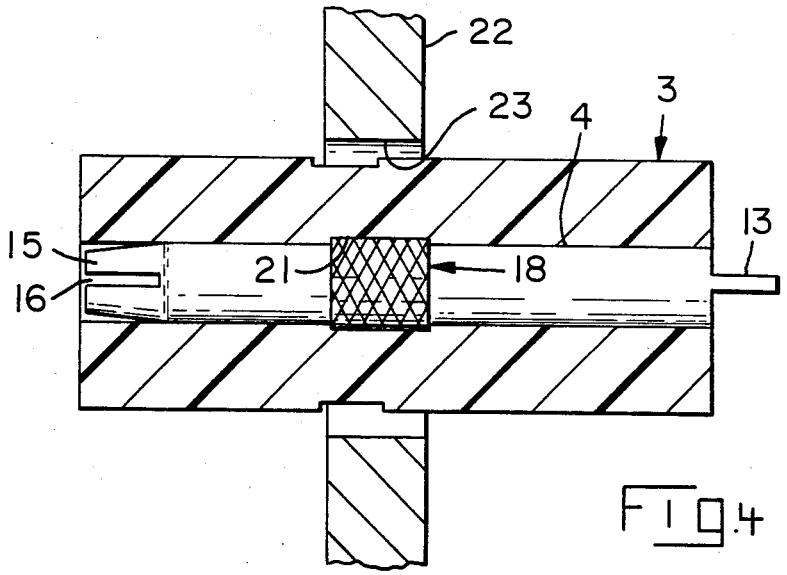
FIG. 4 is a diagrammatic view illustrating induction heating of a center contact and a dielectric body of the connector.
Figure 5:
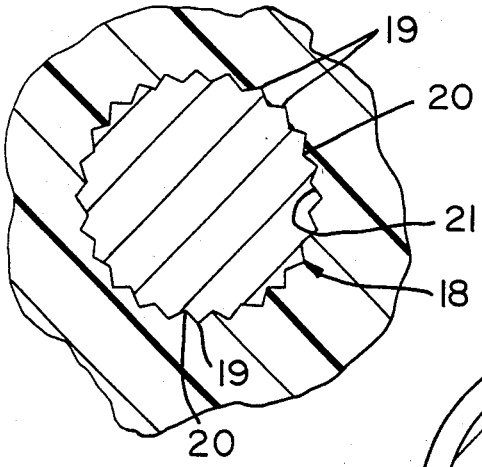
FIG. 5 is an enlarged partial section view taken along the line 5—5 of FIG. 3.

The dielectric body 3 has an axial bore 17. The center contact 4 is mounted in the bore 17 and is coaxially surrounded by the dielectric body 3. As shown in FIGS. 1, 3 and 4, a section of the external surface of the center contact has a roughened surface 18. For example, the roughened surface 18 is provided by knurling having a diamond pattern. FIG. 5 is an enlarged view illustrating the cross section of the knurling. The knurling has radially outward projections 19 and radially recessed portions 20. For example, the projections 19 will increase the nominal diameter of the center contact 4 by 0.004 inches, and the recessed portions will reduce the nominal diameter by 0.004 inches.

As shown in FIG. 4, the contact 4 is assembled in the bore 17 and the dielectric body 3 coaxially surrounds the contact 4 with a compression fit. The interior surface 21 of the dielectric body 3 is made to conform to the recessed portions 20 and projections 19 of the knurling in the following manner. A conductive metal plate 22 has a aperture 23 through its thickness. The assembled dielectric body 3 and center contact 4 is positioned in the aperture 23 with the knurling aligned with the thickness of the plate 22. The plate 22 is subjected to radio frequency energy, thereby inductively heating, or inducing a raise in temperature of, the surface of the knurling. The surface 21 of the dielectric 3 adjacent the knurling is then caused to change from a solid to a fluid state, and to flow into conformity with the recessed portions 20 and projections 19 of the knurling. Thereby the dielectric body 3 is flowed into interlocked engagement with the center contact 4. A suitable thermoplastic dielectric material which can be caused to flow by inductive heating is FEP fluoropolymer. The diamond knurling provides interlocking resistance to axial and rotational movement of the contact 4 with respect to the dielectric body 3.

EXAMPLE

A band of diamond knurling is applied to a gold plated beryllium copper contact 4 of 0.05 inches nominal diameter. The band width is 0.060 inches wide and the depth of the knurling is 0.004 inches. The contact 4 is assembled with a compression fit within an axial bore 17 of a dielectric body 3 of polytetrafluoroethylene FEP having an outer diameter of 0.163 inches. The assembly is inductively heated approximately one second to cause flow of a portion of the surface 21 of the dielectric body 3 adjacent the knurling. The assembly is cooled in ambient temperature conditions. The assembly is transversely sectioned through the band of knurling. A microphotograph of the sectioned assembly is taken and depicted in FIG. 5. An inspection of the microphotograph shows that the surface 21 of the dielectric body 3 is flowed into interlocked engagement with the knurling of the contact 4. The interlocked assembly resists motion of the contact 4 with respect to the dielectric body 3, when ten pounds minimum tension force is applied to the contact 4, and when ten inch-pounds minimum torque is applied to the contact 4.

The assembly of the dielectric body 3 and center contact 4 are assembled with the outer shell 1. The dielectric body 3 is coaxially surrounded by the outer shell 1 with a compression fit. The alignment of the dielectric body 3 and the outer shell 1 is adjusted. Then a solidfiable fluent material 24 such as epoxy is introduced into openings 25 through the thickness of the outer shell 2. The material 24 adheres to the interior surface 26 of the outer shell 2, and is deposited in a recess 27 in the periphery of the dielectric body 3 and encircling the dielectric body 3. Thereby the fluent material 24 is flowed into interlocked engagement with the dielectric body 3. The recess 27 forms the material 24 into a solidfied collar 29, which projects radially inward toward the axis of the dielectric body 3, and which is of precise small size and shape to minimize the impedance mismatch causes by presence of the collar 29 in the connector 1. Further the collar 29 is formed subsequent to assembly of the dielectric body 3 within the outer shell 2. Thereby, the collar 29 is positioned precisely and without contributing to an increase in cumulative tolerances in the assembly of the dielectric body 3 and the outer shell 2.

Figure 6:
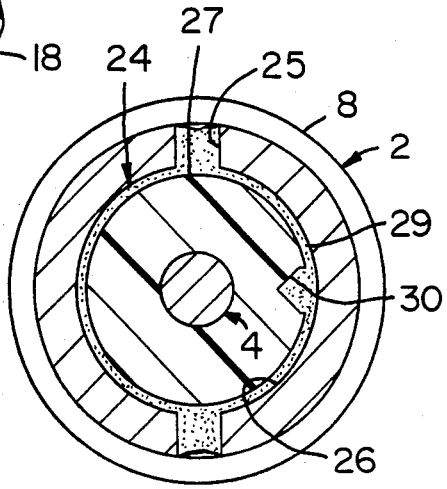
FIG. 6 is an enlarged section view taken along the line 6—6 of FIG. 3.

FIG. 6 shows a dielectric body 3 in which the recess 27 communicates with a radially inward extending recess 30 made by drilling radially into the dielectric body 3. The material 24 flows into interlocked engagement with the recess 30 as well as the recess 27.

Figure 7:
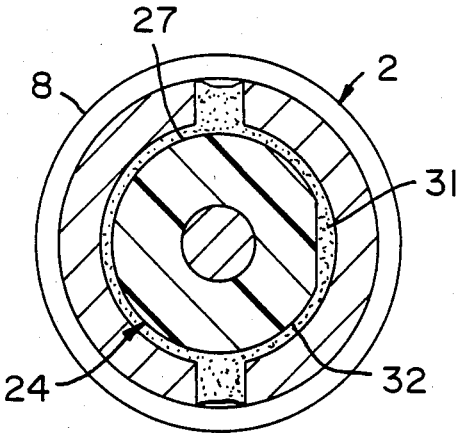
FIG. 7 is an enlarged section view similar to FIG. 6 and illustrating an alternative dielectric body.

FIG. 7 shows a dielectric body 3 in which the recess 27 has a linearly straight portion 31 intersecting an arcuate portion 32 which encircles the axis of the dielectric body. The material 24 flows into interlocked engagement with the straight and circular portions 31 and 32.

Figure 8:
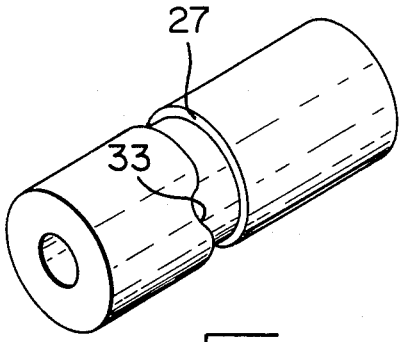
FIG. 8 is an enlarged perspective view of another alternative dielectric body.

FIG. 8 shows a dielectric body 3 with a recess 27 having a sinuous side wall 33. The material 24 flows into interlocked engagement with the sidewall 33.

Although a preferred form of the invention has been described, the claims are intended to cover modifications of the invention and other forms of the invention, for example, a roughed surface 18 which is roughened by a technique other than knurling, or a knurling other than diamond knurling.

We claim:

1. In an electrical connector comprising, a conductive outer shell for releasable connection with an electrical cable, a dielectric body coaxially surrounded by the outer shell, and a conductive electrical contact having a roughened outer surface portion concentrically surrounded by the dielectric body and having an electrical contact portion for releasable connection with the coaxial cable, the improvement comprising;

the electrical contact is coaxially surrounded by the dielectric body with a compression fit, a continuous interior surface portion of the dielectric body concentrically surrounds the roughened outer surface portion, and said interior surface portion having been flowed in a fluid state into interlocked engagement with the roughened surface portion, wherein the dielectric body provides a compression fit and a flowed interlocked engagement with the electrical contact.

* * * * *